US011087656B2

(12) United States Patent
Jose et al.

(10) Patent No.: US 11,087,656 B2
(45) Date of Patent: Aug. 10, 2021

(54) FULLY DIFFERENTIAL FRONT END FOR SENSING

(71) Applicant: Samsung Display Co., Ltd., Yongin-si (KR)

(72) Inventors: Anup P. Jose, San Jose, CA (US); Amir Amirkhany, Sunnyvale, CA (US); Mohamed Elzeftawi, San Jose, CA (US)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/656,447

(22) Filed: Oct. 17, 2019

(65) Prior Publication Data

US 2021/0049943 A1 Feb. 18, 2021

Related U.S. Application Data

(60) Provisional application No. 62/887,395, filed on Aug. 15, 2019.

(51) Int. Cl.
*G09G 3/00* (2006.01)
*G09G 3/32* (2016.01)

(52) U.S. Cl.
CPC ..... *G09G 3/006* (2013.01); *G09G 3/32* (2013.01); *G09G 2320/029* (2013.01)

(58) Field of Classification Search
CPC ..... G09G 3/006; G09G 3/32
(Continued)

(56) References Cited

U.S. PATENT DOCUMENTS 5,239,210 A * 8/1993 Scott ..... H03F 3/3023 327/362
6,753,913 B1 6/2004 Bilhan et al.
(Continued)

FOREIGN PATENT DOCUMENTS

EP 0 986 900 B1 8/2005
EP 2 738 757 A1 6/2014
(Continued)

OTHER PUBLICATIONS

Extended European Search Report for corresponding European Patent Application No. 20156633.8, dated Apr. 16, 2020, 9 pages.
(Continued)

*Primary Examiner* — Prabodh M Dharia
(74) *Attorney, Agent, or Firm* — Lewis Roca Rothgerber Christie LLP

(57) ABSTRACT

A system and method for sensing drive current in a pixel. In some embodiments, the system includes: a first pixel, a second pixel, a differential sensing circuit, a reference current source, and a control circuit. The differential sensing circuit may have a first input, a second input, and an output, the first input being connected to a node at which a reference current generated by the reference current source is subtracted from a first pixel current, the first pixel current including a current generated by the first pixel. The second input may be configured to receive a second pixel current, the second pixel current including a current generated by the second pixel. The output may be configured to produce an output signal based on a difference between a current received at the first input and a current received at the second input.

20 Claims, 13 Drawing Sheets

(58) Field of Classification Search
USPC ..... 345/173, 214; 1/1; 73/504.12
See application file for complete search history.

(56) References Cited

U.S. PATENT DOCUMENTS

| | | | | |
|---|---|---|---|---|
| 6,822,679 | B1 | 11/2004 | Kulhalli et al. | |
| 6,909,391 | B2 | 6/2005 | Rossi | |
| 6,919,551 | B2 | 7/2005 | Barna et al. | |
| 7,245,321 | B2 | 7/2007 | Panicacci et al. | |
| 7,764,118 | B2 | 7/2010 | Kusuda et al. | |
| 8,497,731 | B1 | 7/2013 | Beckwith et al. | |
| 8,659,325 | B2 | 2/2014 | Nishi | |
| 9,191,598 | B2 | 11/2015 | Blanquart et al. | |
| 9,721,504 | B2 | 8/2017 | Kim et al. | |
| 9,722,582 | B2 | 8/2017 | Jung | |
| 10,714,051 | B1 | 7/2020 | Huang et al. | |
| 10,762,836 | B1 | 9/2020 | Bae et al. | |
| 2005/0243193 | A1 | 11/2005 | Gove et al. | |
| 2005/0248671 | A1 | 11/2005 | Schweng | |
| 2006/0139097 | A1 | 6/2006 | Mukherjee et al. | |
| 2006/0238477 | A1 | 10/2006 | Lew et al. | |
| 2007/0030262 | A1 | 2/2007 | Ambo et al. | |
| 2007/0080908 | A1 | 4/2007 | Nathan et al. | |
| 2009/0058324 | A1 | 3/2009 | Nakao | |
| 2009/0237121 | A1 | 9/2009 | Surendranath et al. | |
| 2010/0271517 | A1 | 10/2010 | De Wit et al. | |
| 2013/0082936 | A1* | 4/2013 | Islamkulov ..... | H01L 27/14609 345/173 |
| 2013/0099692 | A1 | 4/2013 | Chaji et al. | |
| 2013/0100173 | A1 | 4/2013 | Chaji et al. | |
| 2013/0141368 | A1 | 6/2013 | Wang et al. | |
| 2014/0152642 | A1 | 6/2014 | Kim et al. | |
| 2014/0198092 | A1 | 7/2014 | Azizi et al. | |
| 2015/0009204 | A1* | 1/2015 | Chaji ..... | G09G 3/3233 345/214 |
| 2015/0195569 | A1 | 7/2015 | Jung et al. | |
| 2015/0213757 | A1 | 7/2015 | Takahama et al. | |
| 2015/0243221 | A1 | 8/2015 | Lim | |
| 2015/0261341 | A1 | 9/2015 | Weinerth et al. | |
| 2016/0005358 | A1 | 1/2016 | Wang | |
| 2016/0012765 | A1 | 1/2016 | Jeong | |
| 2016/0055791 | A1 | 2/2016 | Kishi et al. | |
| 2016/0202061 | A1* | 7/2016 | Maurer ..... | G01C 19/5762 73/504.12 |
| 2016/0261817 | A1 | 9/2016 | Totsuka et al. | |
| 2016/0267844 | A1 | 9/2016 | Senda et al. | |
| 2016/0372044 | A1 | 12/2016 | Kwon et al. | |
| 2017/0003779 | A1* | 1/2017 | Reynolds ..... | G06F 3/0445 |
| 2017/0039939 | A1 | 2/2017 | Chaji | |
| 2017/0039953 | A1 | 2/2017 | Lee | |
| 2017/0090669 | A1* | 3/2017 | Paladugu ..... | G06F 3/0443 |
| 2017/0154573 | A1 | 6/2017 | Woo et al. | |
| 2018/0100943 | A1 | 4/2018 | Sternberg | |
| 2018/0114815 | A1 | 4/2018 | Lee et al. | |
| 2018/0182303 | A1 | 6/2018 | Jung et al. | |
| 2018/0336816 | A1 | 11/2018 | Shin et al. | |
| 2019/0035351 | A1 | 1/2019 | Pyun et al. | |
| 2019/0088205 | A1* | 3/2019 | Zhang ..... | G09G 3/3258 |
| 2019/0221146 | A1* | 7/2019 | Lin ..... | G09G 3/3648 |
| 2019/0247664 | A1* | 8/2019 | Irazoqui ..... | A61B 5/08 |
| 2019/0336757 | A1* | 11/2019 | Rodriguez ..... | A61N 1/0412 |
| 2020/0091884 | A1* | 3/2020 | Venkatraman ..... | G01L 1/2287 |
| 2020/0184888 | A1 | 6/2020 | Brownlow et al. | |
| 2020/0202787 | A1 | 6/2020 | Do et al. | |

FOREIGN PATENT DOCUMENTS

| | | | |
|---|---|---|---|
| EP | 3 343 556 | A1 | 7/2018 |
| KR | 10-2008-0107064 | A | 12/2008 |
| KR | 10-2013-0053458 | A | 5/2013 |

OTHER PUBLICATIONS

U.S. Appl. No. 16/656,423, filed Nov. 6, 2019.
U.S. Appl. No. 16/656,447, filed Oct. 17, 2019.
U.S. Appl. No. 16/657,680, filed Oct. 18, 2019.
U.S. Office Action dated Nov. 5, 2020, issued in U.S. Appl. No. 16/848,706 (22 pages).
Chen, Hsin-Liang, et al.; A Low-Offset Low-Noise Sigma-Delta Modulator With Pseudorandom Chopper-Stabilization Technique, IEEE Transactions on Circuits and Systems—I: Regular Papers, vol. 56, No. 12, Dec. 2009, 11 pages.
Extended European Search Report for corresponding European Patent Application No. 20179974.9, dated Aug. 20, 2020, 12 pages.
Extended European Search Report for corresponding European Patent Application No. 20176949.4, dated Aug. 27, 2020, 13 pages.
U.S. Notice of Allowance dated Sep. 9, 2020, issued in U.S. Appl. No. 16/657,680 (8 pages).
U.S. Office Action dated Jan. 28, 2021, issued in U.S. Appl. No. 16/869,546 (10 pages).
U.S. Notice of Allowance dated Jun. 1, 2021, issued in U.S. Appl. No. 16/656,423 (13 pages).

* cited by examiner

FULLY DIFFERENTIAL FRONT END FOR SENSING

CROSS-REFERENCE TO RELATED APPLICATION(S)

The present application claims priority to and the benefit of U.S. Provisional Application No. 62/887,395, filed Aug. 15, 2019, entitled "FULLY DIFFERENTIAL FRONT-END WITH SENSING OF ADJACENT SUB-PIXELS", the entire content of which is incorporated herein by reference.

FIELD

One or more aspects of embodiments according to the present disclosure relate to displays, and more particularly to measuring pixel characteristics.

BACKGROUND

A video display such as those used for computers or mobile devices may have a plurality of pixels, and, in each pixel, a plurality of transistors, including a drive transistor configured to control a drive current through a display element such as a light emitting diode (LED) (e.g., an organic light emitting diode (OLED)). Variations between the characteristics of the drive transistors of the display, or changes with time of the characteristics of any one of the drive transistors may, if not compensated for, degrade the quality of images or video displayed by the display. To compensate for such variation, or changes, it may be advantageous to measure the characteristics of the drive transistors.

Thus, there is a need for a system and method for measuring characteristics of drive transistors in a display.

SUMMARY

According to an embodiment of the present disclosure, there is provided a system, including: a first pixel; a second pixel; a differential sensing circuit; a reference current source; and a control circuit, the differential sensing circuit having a first input, a second input, and an output, the first input being connected to a node at which a reference current generated by the reference current source is subtracted from a first pixel current, the first pixel current including a current generated by the first pixel; the second input being configured to receive a second pixel current, the second pixel current including a current generated by the second pixel; the output being configured to produce an output signal based on a difference between a current received at the first input and a current received at the second input; the control circuit being configured to: cause the first pixel to be turned on; cause the second pixel to be turned off; and cause the reference current source to generate the reference current.

In some embodiments: the system includes a display panel including the first pixel and the second pixel, the first pixel is in a first column of the display panel, the second pixel is in a second column of the display panel, and the first pixel and the second pixel are adjacent, and in the same row of the display panel.

In some embodiments: the first pixel current further includes leakage currents from a plurality of pixels in the first column, other than the first pixel, and the second pixel current includes leakage currents from a plurality of pixels in the second column, other than the second pixel.

In some embodiments, the differential sensing circuit includes a low-pass current filter.

In some embodiments, the low-pass current filter includes a fully differential amplifier.

In some embodiments, the low-pass current filter further includes a common-mode feedback circuit with a bandwidth of at least 1 MHz.

In some embodiments, the differential sensing circuit further includes an integrator, connected to an output of the low-pass current filter.

In some embodiments, the system further includes a drive circuit, wherein a first conductor of the display panel is connected to the first pixel, the first conductor being configured: in a first state of the system, to carry the first pixel current, and in a second state of the system, to carry a current from the drive circuit to the first pixel.

In some embodiments, the control circuit is configured, in the second state: to cause the low-pass current filter to operate in a reset state, and to cause the drive circuit to drive the first conductor to a reference voltage.

According to an embodiment of the present disclosure, there is provided a method for sensing a current in a display, the display including: a first pixel; a second pixel; a differential sensing circuit; and a reference current source; the differential sensing circuit having a first input, a second input, and an output, the method including: feeding to the first input the difference between a first pixel current and a reference current generated by the reference current source, the first pixel current including a current generated by the first pixel; feeding to the second input a second pixel current, the second pixel current including a current generated by the second pixel; producing at the output an output signal based on a difference between the current received at the first input and the current received at the second input; turning the first pixel on; turning the second pixel off; and generating the reference current.

In some embodiments: the display includes a display panel including the first pixel and the second pixel, the first pixel is in a first column of the display panel, the second pixel is in a second column of the display panel, and the first pixel and the second pixel are adjacent, and in the same row of the display panel.

In some embodiments: the first pixel current further includes leakage currents from a plurality of pixels in the first column, other than the first pixel, and the second pixel current includes leakage currents from a plurality of pixels in the second column, other than the second pixel.

In some embodiments, the differential sensing circuit includes a low-pass current filter.

In some embodiments, the low-pass current filter includes a fully differential amplifier.

In some embodiments, the low-pass current filter further includes a common-mode feedback circuit with a bandwidth of at least 1 MHz.

In some embodiments, the differential sensing circuit further includes an integrator, connected to an output of the low-pass current filter.

In some embodiments, the display further includes a drive circuit, wherein a first conductor of the display panel is connected to the first pixel, the first conductor being configured: in a first state of the display, to carry the first pixel current, and in a second state of the display, to carry a current from the drive circuit to the first pixel.

In some embodiments, the method further includes, in the second state: operating the low-pass current filter in a reset state, and driving, by the drive circuit, the first conductor to a reference voltage.

According to an embodiment of the present disclosure, there is provided a system, including: a first pixel; a second pixel; a differential sensing circuit; a reference current source; and means for controlling, the differential sensing circuit having a first input, a second input, and an output, the first input being connected to a node at which a reference current generated by the reference current source is subtracted from a first pixel current, the first pixel current including a current generated by the first pixel; the second input being configured to receive a second pixel current, the second pixel current including a current generated by the second pixel; the output being configured to produce an output signal based on a difference between a current received at the first input and a current received at the second input; the means for controlling being configured to: cause the first pixel to be turned on; cause the second pixel to be turned off; and cause the reference current source to generate the reference current.

In some embodiments: the system includes a display panel including the first pixel and the second pixel, the first pixel is in a first column of the display panel, the second pixel is in a second column of the display panel, the first pixel and the second pixel are adjacent, and in the same row of the display panel.

BRIEF DESCRIPTION OF THE DRAWINGS

These and other features and advantages of the present disclosure will be appreciated and understood with reference to the specification, claims, and appended drawings wherein:

DETAILED DESCRIPTION

The detailed description set forth below in connection with the appended drawings is intended as a description of exemplary embodiments of a system and method for sensing drive current in a pixel provided in accordance with the present disclosure and is not intended to represent the only forms in which the present disclosure may be constructed or utilized. The description sets forth the features of the present disclosure in connection with the illustrated embodiments. It is to be understood, however, that the same or equivalent functions and structures may be accomplished by different embodiments that are also intended to be encompassed within the scope of the disclosure. As denoted elsewhere herein, like element numbers are intended to indicate like elements or features.

Figure 1:
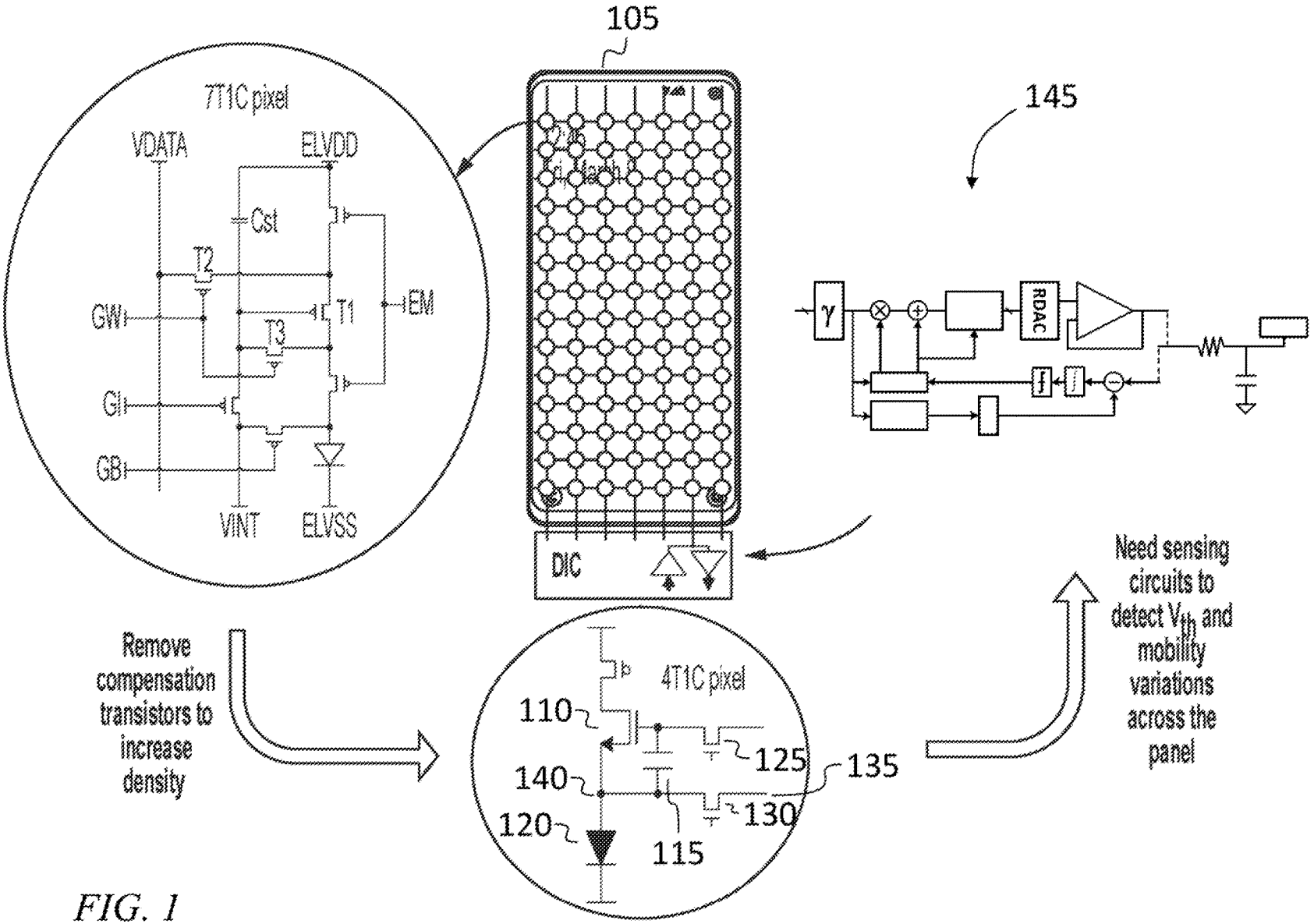
FIG. 1 is a context diagram, according to an embodiment of the present disclosure.

Referring to FIG. 1, in some embodiments a display (e.g., a mobile device display) 105 may include a plurality of pixels arranged in rows and columns. Each pixel may be configured to produce light of one color (e.g., red, green or blue) and may be part of a composite pixel that includes, e.g., three such pixels and that is configured to produce any of a wide range of colors (in some contexts, what is referred to herein as a "pixel" is instead referred to as a "sub-pixel", and what is referred to herein as a "composite pixel" is instead referred to as a "pixel"). Each pixel may include a drive circuit, e.g., 7-transistor 1-capacitor (7T1C) drive circuit as shown on the left of FIG. 1 or a 4-transistor 1-capacitor (4T1C) drive circuit as shown at the bottom of FIG. 1. In the 4T1C drive circuit, a drive transistor 110 (the gate-source voltage of which is controlled by the capacitor 115) controls the current through the light emitting diode 120 when the pixel is emitting light. An upper pass-gate transistor 125 may be used to selectively connect the gate of the drive transistor 110 (and one terminal of the capacitor 115) to a power supply voltage, and a lower pass-gate transistor 130 may be used to selectively connect a drive sense conductor 135 to a source node 140 (which is a node connected to the source of the drive transistor 110, to the anode of the light emitting diode 120 and to the other terminal of the capacitor 115).

A pixel drive and sense circuit 145 (discussed in further detail below) may be connected to the drive sense conductor 135. The pixel drive and sense circuit 145 may include a drive amplifier and a sensing circuit, configured to be selectively connected, one at a time, to the drive sense conductor 135. When current flows through the drive transistor 110, and the lower pass-gate transistor 130 is turned off, disconnecting the drive sense conductor 135 from the source node 140, current may flow through the light emitting diode 120, causing it to emit light. When the lower pass-gate transistor 130 is turned on and the drive sense conductor 135 is driven to a lower voltage than the cathode of the light emitting diode 120, the light emitting diode 120 may be reverse-biased and any current flowing in the drive sense conductor 135 may flow to the pixel drive and sense circuit 145, where it may be sensed. This sensed current may be compared to a desired current (e.g., the current that an ideal, or nominal transistor would drive at the same gate-source voltage), and to the extent that the sensed current differs from the ideal current, measures may be taken (e.g., the gate-source voltage may be adjusted) to compensate for the discrepancy.

Figure 2A:
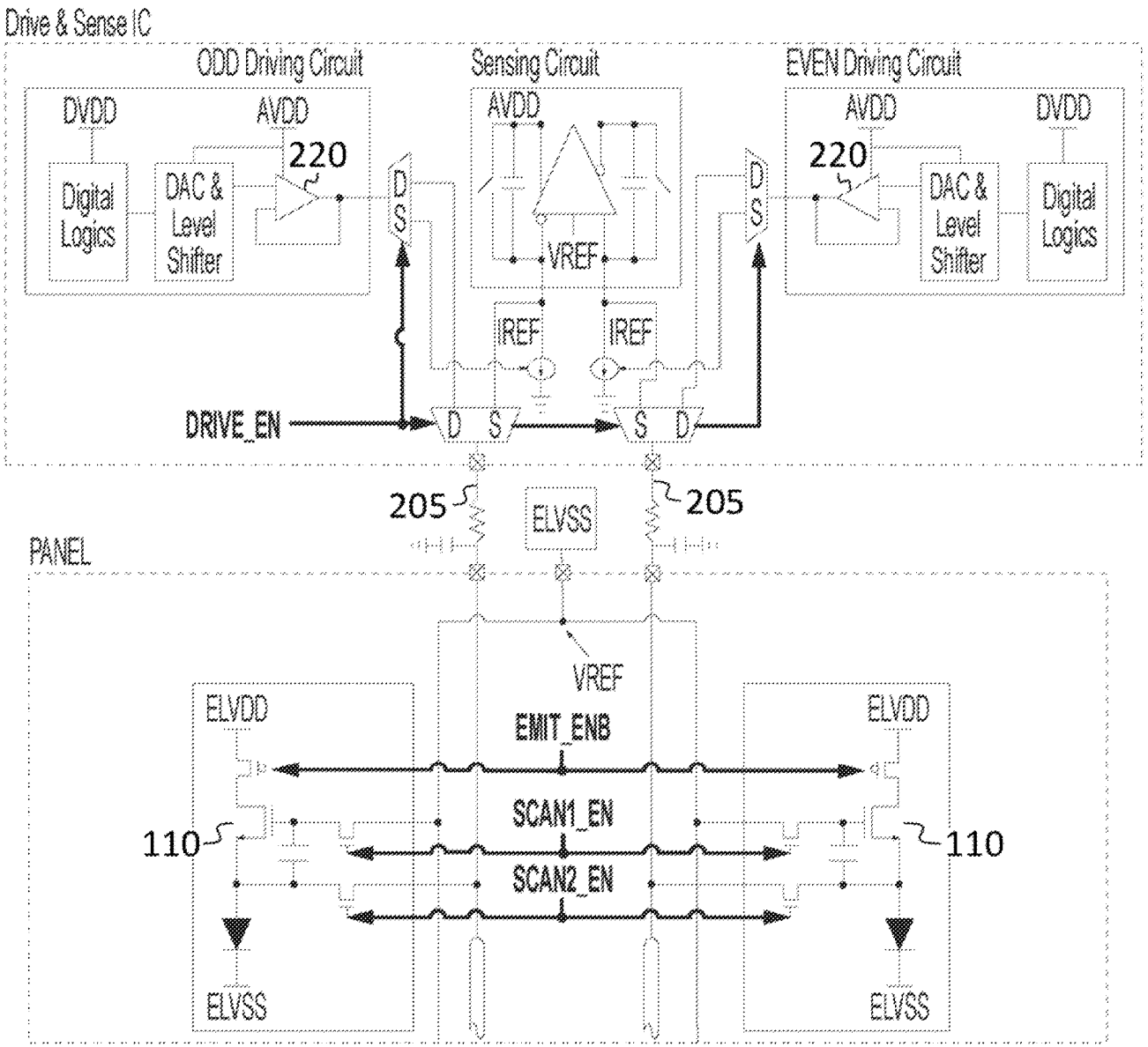
FIG. 2A is a schematic diagram of a display panel and a drive and sense integrated circuit, according to an embodiment of the present disclosure.

Referring to FIG. 2A, in some embodiments, the current of any pixel may be sensed in a differential manner, for improved accuracy. For example, if the current driven by the drive transistor 110 of the pixel on the left of FIG. 2A (which may be referred to as an "odd" pixel) is to be sensed, it may be turned on (by charging capacitor of the odd pixel so as to turn on the drive transistor 110 of the odd pixel), and the drive transistor 110 of the pixel on the right of FIG. 2A (which may be referred to as an "even" pixel) may be turned off (by discharging the capacitor of the even pixel so as to turn off the drive transistor 110 of the even pixel) and the difference between the two corresponding currents flowing out of two respective conductors, which may be referred to as "column conductors" 205, may be measured. Each of the column conductors 205 may be connected to all of the pixels of a column of the display; as a result, even if all of the pixels, other than the odd pixel being characterized, are turned off, the total leakage current in the other pixels may be significant. To the extent that the leakage currents in the adjacent column (containing the even pixel) are the same, the contribution of the leakage currents to the current flowing in the column conductor connected to the odd pixel may be canceled when the difference between the currents in the two column conductors 205 is sensed.

The SCAN1, SCAN2, and EMIT control lines may be per row, and may have different timing between rows. As mentioned above, differential sensing may be used, so that half the pixels in a row are sensed per operation. The same set of gate control signals may be applied to odd and even pixels, such that there is no distinction between odd and even pixels. Each digital to analog converter and associated drive amplifier 220 may be used both to drive a column conductor 205 to charge the capacitor of a pixel, and to generate the reference current when the current driven by the drive transistor 110 is being sensed; this may be accomplished using multiplexers, as shown. The embodiment of FIG. 1 does not include this feature and instead includes two separate digital to analog converters.

Figure 2B:
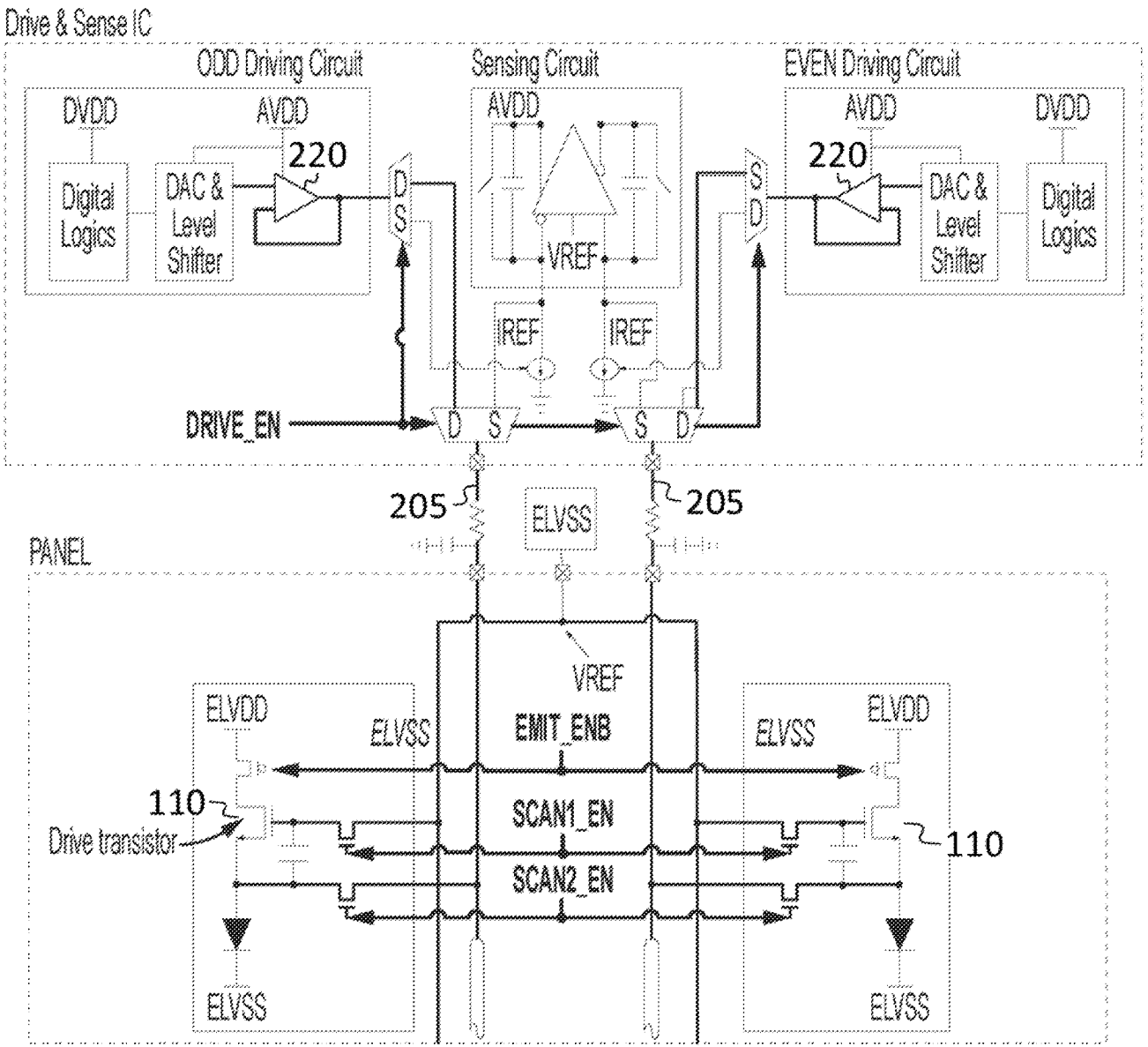
FIG. 2B is a schematic diagram of a display panel and a drive and sense integrated circuit, according to an embodiment of the present disclosure.

Referring to FIG. 2B, in some embodiments, when the circuit is in drive mode, the gate of the drive transistor 110 of each pixel is at ELVSS, and the source of the drive transistor 110 of each pixel is driven to ELVSS−VDRIVE, so that $$VGS=\text{ELVSS}-(\text{ELVSS}-\text{VDRIVE})=\text{VDRIVE}.$$

The emit transistor of each pixel may remain turned off.

In this process, a respective VDRIVE may be stored across the pixel capacitor of each the pixels. When sensing the odd pixel, the VDRIVE used for the drive transistor 110 of the even pixel may be ELVSS, so that it will be turned off, as mentioned above.

Figure 2C:
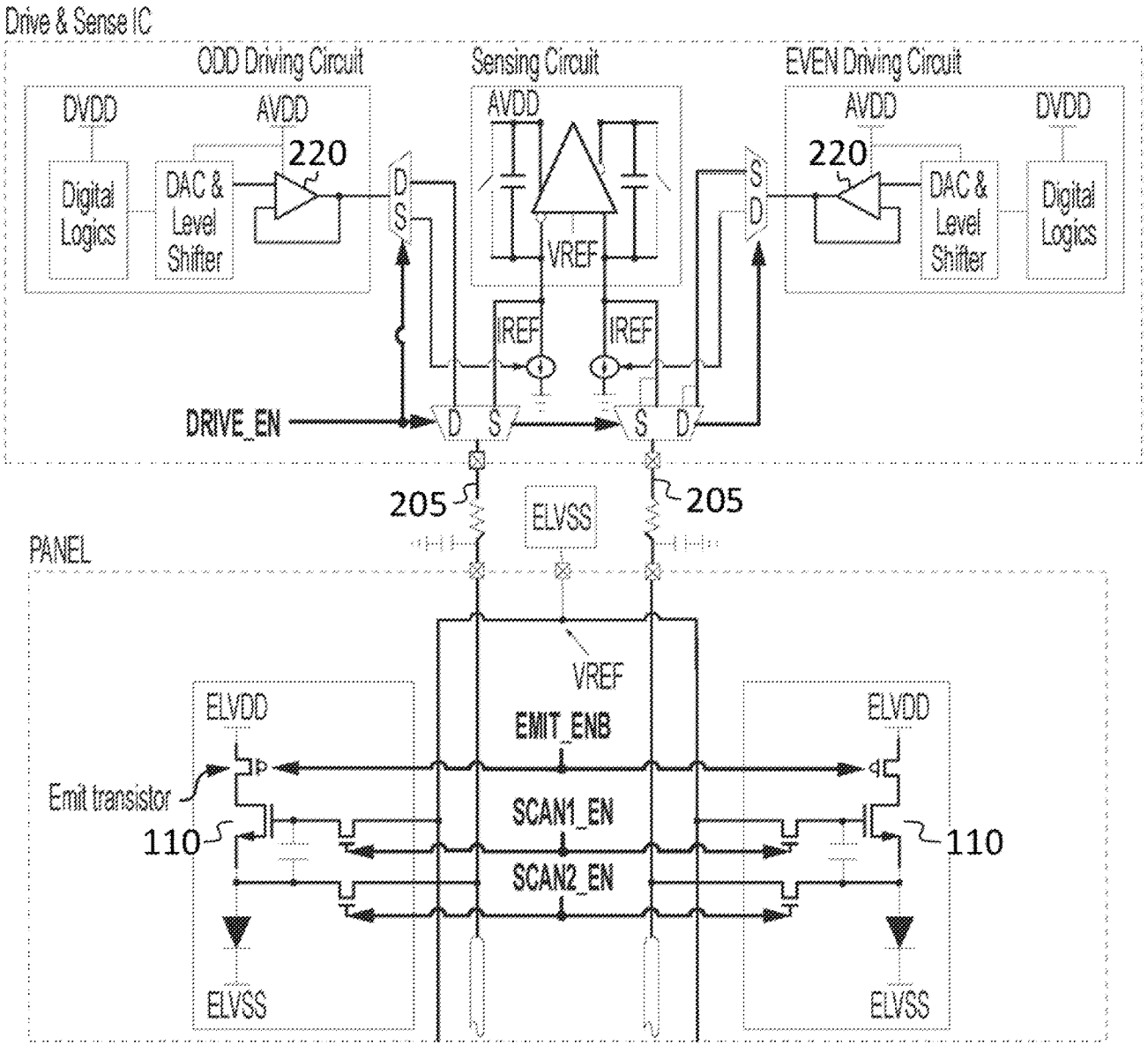
FIG. 2C is a schematic diagram of a display panel and a drive and sense integrated circuit, according to an embodiment of the present disclosure.

Referring to FIG. 2C, in some embodiments, when the circuit is in sense mode, the upper pass-gate transistors 125 (FIG. 1) are turned off so that the gates of the drive transistors 110 float, and so that the charge on the capacitor of each pixel remains constant. The source of the drive transistor 110 of each pixel is driven (e.g., to VREF, which may be slightly less than ELVSS) so that each light emitting diode 120 is reverse-biased, and so that no current flows through the light emitting diodes 120. The emit transistor of each pixel is turned on, and as a result of the light emitting diode 120 being reverse-biased, any current driven by the drive transistor 110 of a pixel flows through a respective column conductor 205 to the sensing circuit. In this mode, the digital to analog converter and the drive amplifier 220 connected to it may generate the reference current IREF. In some embodiments the reference current is generated by controlling the digital to analog converter and the drive amplifier 220 to produce a voltage ramp, which is applied to a capacitor to provide a current according to the following equation:

$$\text{IREF}=CdV/dt$$

Figure 3A:
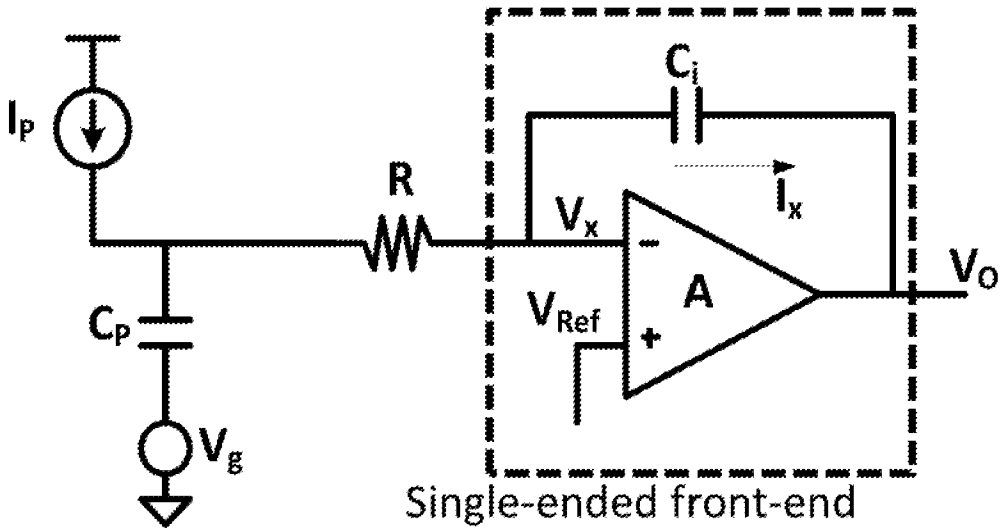
FIG. 3A is a schematic diagram of a front end, according to an embodiment of the present disclosure.

Various sources of error may be relevant when sensing pixel currents. For example, referring to FIG. 3A, if current is sensed with a single-ended front end, ground noise $V_g$ may couple into the signal at the output of the amplifier according to the following equation:

$$V_O=-\frac{A}{A+1}\frac{1}{\left(\frac{C_P}{(A+1)C_i}+1\right)}\frac{1}{1+sR[C_P\|C_i(A+1)]}\frac{1}{sCi}I_{in}+\frac{A}{A+1}\frac{Cp\|Ci(1+A)}{Ci}*\frac{1}{1+sRCp\|Ci(1+A)}V_g.$$

For display systems $C_P$ may be much larger than $C_i$; as a result ground noise ($V_g$) may be very large at low frequencies.

Figure 3B:
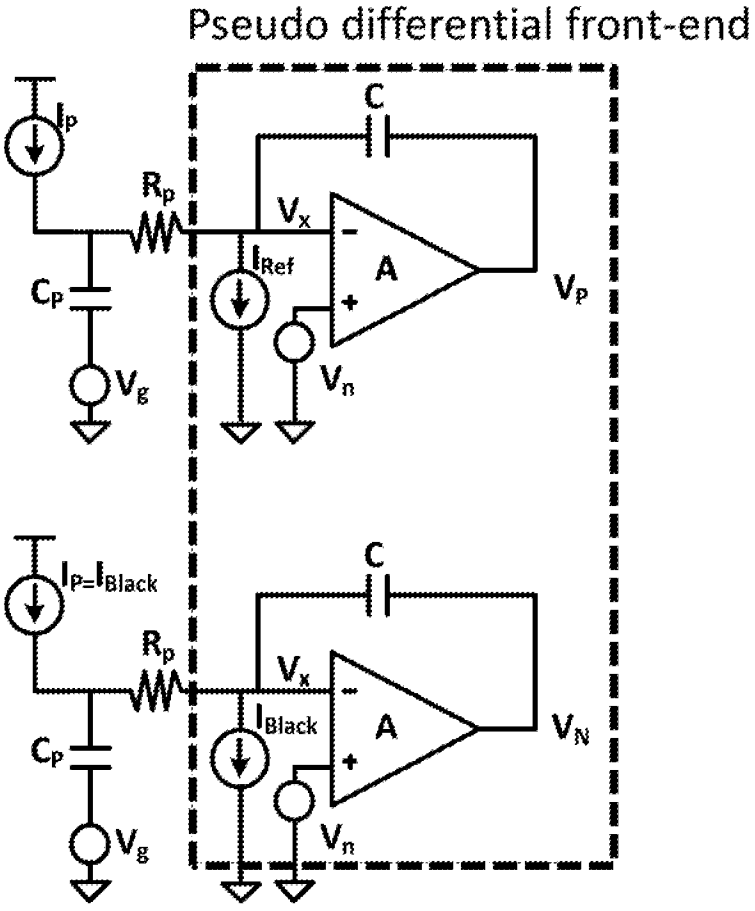
FIG. 3B is a schematic diagram of a front end, according to an embodiment of the present disclosure.

Referring to FIG. 3B, pseudo-differential sensing (sensing the difference between an on pixel and an off pixel, as described above, using a pseudo-differential front end) may be effective when the column capacitance ($C_P$) of the two columns matches, but it may be ineffective even with a mismatch of between 1% and 5%. Moreover, the common-mode current caused by the noise may be excessive and may increase the dynamic range requirements of the front end.

Figure 3C:
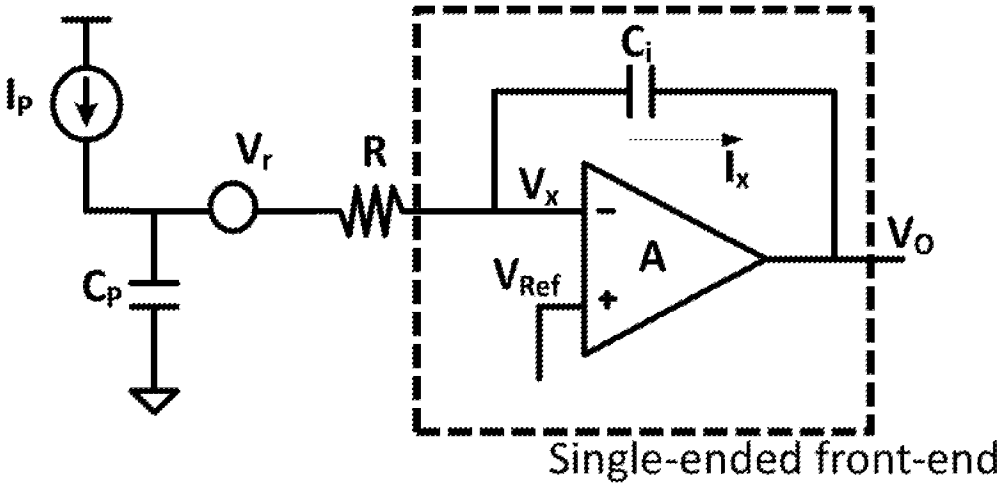
FIG. 3C is a schematic diagram of a front end, according to an embodiment of the present disclosure.

Referring to FIG. 3C, if current is sensed with a single-ended front end, thermal noise $V_r$ may couple into the signal at the output of the amplifier according to the following equation:

$$V_O=-\frac{A}{A+1}\frac{1}{\left(\frac{C_P}{(A+1)C_i}+1\right)}\frac{1}{1+sR[C_P\|C_i(A+1)]}\frac{1}{sCi}I_{in}+\frac{A}{A+1}\frac{Cp\|Ci(1+A)}{Ci}*\frac{1}{1+sRCp\|Ci(1+A)}V_r$$

The effect of this wideband thermal noise, which may be generated by the resistance of the column conductor 205 (modeled, in FIG. 3C, by the resistance $R_P$) may be reduced by using a front end that is configured as, or includes, a low-pass filter, which may pass the (DC) signal ($I_{pixel}$) being sensed. An example of such a low-pass filter (an integrator) is shown in FIG. 3C.

In operation, the front-end integrator may be reset prior to the sense operation. Each sense operation may be preceded by a drive operation during which the drive amplifier 220 (FIGS. 2A-2C) drives the column conductor 205 to a set voltage. Before a sense operation starts, the voltage on the column conductor 205 may be restored to VREF. Another issue of concern with the circuit of FIG. 3C may be that because the capacitance to ground of the column conductor 205 may be large, the sense amplifier (in reset mode) may require a long time to bring the voltage of the column conductor 205 to VREF.

Figure 4:
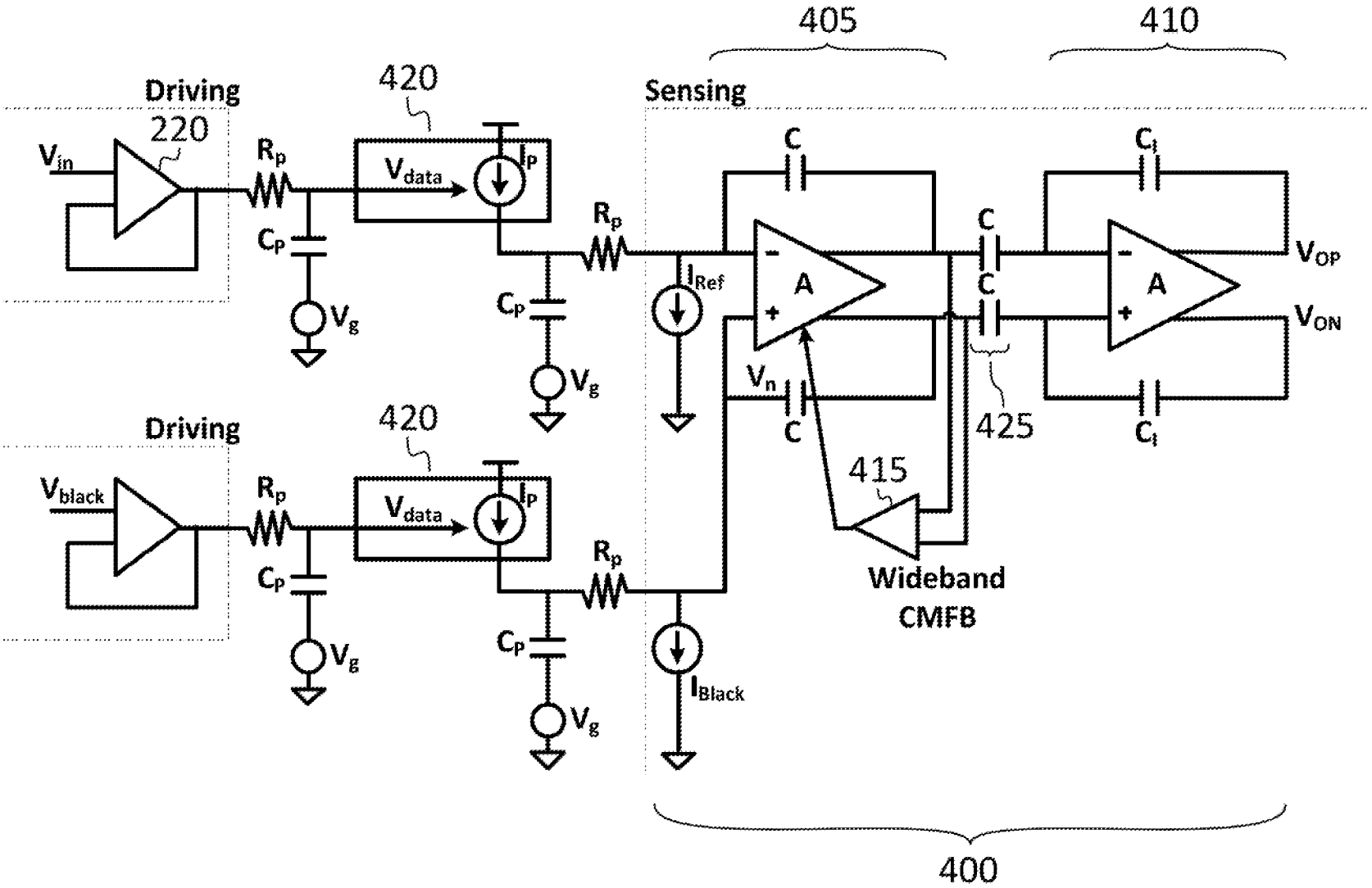
FIG. 4 is a schematic diagram, according to an embodiment of the present disclosure.

FIG. 4 shows a differential sensing circuit 400, with two inputs for sensing a difference between a current from a first pixel (e.g., the odd pixel of FIGS. 2A-2C) and a second pixel (e.g., the even pixel of FIGS. 2A-2C) (each current having subtracted from it a respective reference current). The differential sensing circuit has a two-stage architecture with a low-pass current filter 405 (e.g., a first integrator, as shown) as the first stage, and an integrator 410 (e.g., a second integrator, as shown) as the second stage. The integrator 410 may be coupled to the low-pass current filter 405 by two mirroring capacitors 425. Each of the low-pass current filter 405 and the integrator 410 may include a fully differential operational amplifier with a capacitor (or "feedback capacitor" in each feedback path. As mentioned above, the circuit may be used to perform differential sensing between two adjacent pixels (e.g. a red pixel and a green pixel (of a composite pixel containing three pixels, a red pixel, a green pixel, and a blue pixel), or a green pixel and a blue pixel of a composite pixel). A wideband common mode feedback amplifier 415 (which may have an open loop bandwidth of between 10 MHz and 100 MHz) feeds back around the low-pass current filter 405.

For ease of illustration, the circuit of FIG. 4 shows both the drive amplifier 220 and the differential sensing circuit 400 simultaneously connected to the pixels 420 through respective resistor-capacitor networks used to model the column conductors 205. In some embodiments, however, there is only one column conductor 205 per pixel, and either the drive amplifier 220 or the differential sensing circuit 400 is connected to it at any time (as shown in FIGS. 2A-2C, in which multiplexers are used to select whether the drive amplifier 220 or the differential sensing circuit is connected to the column conductor 205 at any time).

In some embodiments, the low-pass current filter 405 and the integrator 410 may be fully differential. As used herein, a fully differential circuit is one that (unlike a single-ended or pseudo-differential amplifier) does not compare the signal to ground. Instead, each differential gain stage in a fully differential amplifier, for example, compares the two signals being processed directly to each other.

The wideband common mode feedback amplifier 415 may compute the common mode output signal at the output of the low-pass current filter 405 (e.g., it may compute the average of the voltages at the two output conductors using a resistor network), and feed back to a common mode input in the low-pass current filter 405. The common mode input may be, for example, (i) a gate of a current source (or "tail current source") connected to the two sources of a differential pair in the low-pass current filter 405, or (ii) a node connected to two corresponding transistors in the load network of a differential pair in the low-pass current filter 405.

In some embodiments, the performance of the circuit of FIG. 4 may be superior to that of a pseudo-differential circuit (e.g., as illustrated in FIG. 3B). This may be shown as follows.

$$v_1 - v_2 = \frac{v_g R_d \Delta R_2}{(R_1 + R_2 + R_d)(R_1 + R_2' + R_d)}$$

and $$\frac{v_1 - v_2}{v_g} \approx \frac{R_d \Delta R_2}{(R_1 + R_2 + R_d)^2}.$$

Figure 5A:
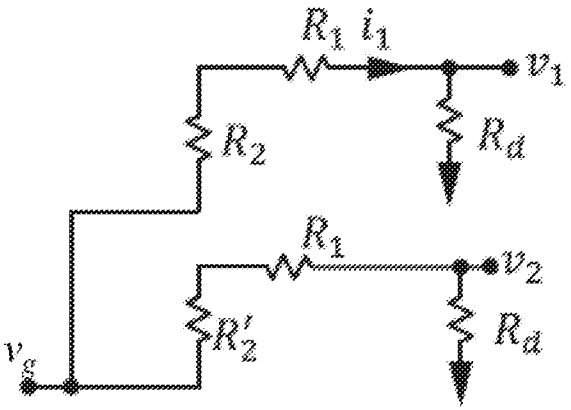
FIG. 5A is a schematic diagram, according to an embodiment of the present disclosure.
Figure 5B:
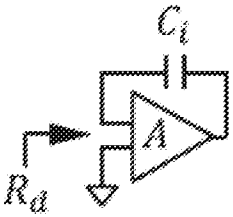
FIG. 5B is a schematic diagram, according to an embodiment of the present disclosure.

Noting that $$R_2 = \left(\frac{1}{sCp}\right)$$

and referring to the circuit of FIG. 5B, it may be found that $$R_d = \frac{1}{sC_i\left[1 + \frac{A}{1 + \frac{s}{\omega_{3dB}}}\right]}$$

and $$R_d = \begin{cases} \frac{1}{sC_iA}; f \ll f_{3dB} \\ \frac{1}{C_iA\omega_{3dB}}; f_{3dB} \ll f \ll f_{ug} \end{cases}$$

Figure 5C:
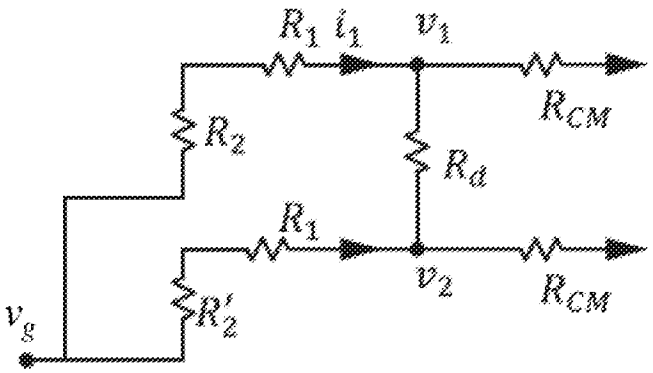
FIG. 5C is a schematic diagram, according to an embodiment of the present disclosure.

FIG. 5C shows a circuit that may be used to analyze the low-pass current filter 405 of FIG. 4. In this circuit:

$$\begin{cases} i_1 = \frac{v_1 - v_2}{R_d} + \frac{v_1}{R_{CM}} \\ i_2 = \frac{v_2 - v_1}{R_d} + \frac{v_2}{R_{CM}} \end{cases}$$

from which it follows that $$\begin{cases} v_1 - v_2 = \frac{i_1 - i_2}{\left[\frac{2}{R_d} + \frac{1}{R_{CM}}\right]} \\ v_1 + v_2 = (i_1 + i_2)R_{CM} \end{cases}$$

Figure 5D:
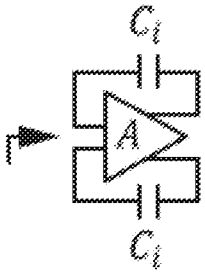
FIG. 5D is a schematic diagram, according to an embodiment of the present disclosure.

Referring to FIG. 5D, it is noted that the differential impedance is $$\frac{R_d}{2}\Big\|R_{CM} \simeq \left(\frac{R_d}{2}\right) \rightarrow \frac{1}{sC_iA}$$

and that the common mode impedance is $$R_{CM} = \frac{1}{sC_i}.$$

The following definitions are used:

$$R_{eff} \triangleq \frac{R_d}{2}\Big\|R_{CM} \approx \frac{R_d}{2}$$

$$R_{tot} \triangleq \frac{R_{eff}}{2} + \frac{R_{CM}}{2} + R_1 + R_2$$

$$R_{tot}' \triangleq \frac{R_{eff}}{2} + \frac{R_{CM}}{2} + R_1 + R_2'.$$

From the previous equations:

$$\frac{i_1}{v_g} = \frac{R_{tot}' + \frac{R_{eff}}{2} - \frac{R_{CM}}{2}}{R_{tot}R_{tot}' - \left(\frac{R_{eff}}{2} - \frac{R_{CM}}{2}\right)^2}$$

-continued $$\frac{i_2}{v_g} = \frac{R_{tot} + \frac{R_{eff}}{2} - \frac{R_{CM}}{2}}{R_{tot}R'_{tot} - \left(\frac{R_{eff}}{2} - \frac{R_{CM}}{2}\right)^2}$$

$$\frac{i_1 - i_2}{v_g} = \frac{\Delta R_2}{R_{tot}R'_{tot} - \left(\frac{R_{eff}}{2} - \frac{R_{CM}}{2}\right)^2}$$

$$\frac{i_1 - i_2}{v_g} \simeq \frac{\Delta R_2}{\frac{R_d}{2} \cdot R_{CM} + (R_1 + R_2)^2 + R_{CM}(R_1 + R_2)}$$

Figure 5E:
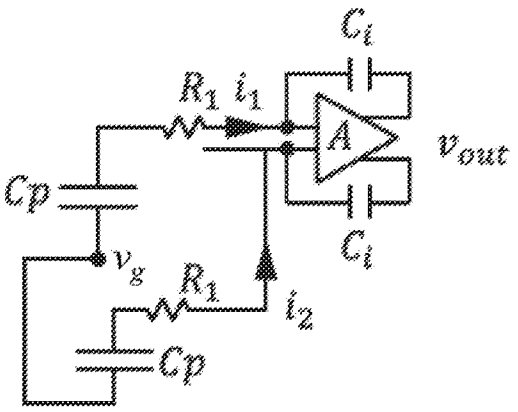
FIG. 5E is a schematic diagram, according to an embodiment of the present disclosure.

Referring to FIG. 5E, the following may be approximate component values:

$R_1 \rightarrow 9$ k $C_P \rightarrow 53$ pF $C_i \rightarrow 71$ fF $A \rightarrow 10{,}000$ For $f \ll f_{3\ dB}$, and using the following assumptions:

$$R_{CM} \gg R_1,\ R_2,\ \frac{R_d}{2}$$

$$R_2 \gg \frac{R_d}{2}, \text{ i.e., } \frac{1}{sC_P} \gg \frac{1}{sC_iA}, \text{ and}$$

$$R_2 \gg R_1,$$

the following may be derived:

$$\frac{i_1 - i_2}{v_g} \simeq \frac{\Delta R_2}{R_{CM} \cdot R_2} = \frac{\Delta C_P}{C_P}(sC_i)$$

and $$v_{out} = (i_1 - i_2)\left(\frac{1}{sC_i}\right) = v_g \frac{\Delta C_P}{C_P}.$$

For $f_{3dB} \ll f \ll f_{ug}$ with $f_{ug} \equiv f_{3dB} \cdot A$ $$\frac{R_d}{2} = \frac{1}{AC_i\omega_{3dB}} \text{(resistor)}$$

and $$\frac{i_1 - i_2}{v_g} = \frac{\Delta C_P}{\Delta C_P{}^2 \frac{1}{AC_i\omega_{3dB}} \cdot \left(\frac{1}{\Delta C_i}\right)}$$

the following result, for higher frequencies, is obtained:

$$v_{out} = (i_1 - i_2)\frac{1}{\Delta C_i} = v_g \frac{\Delta C_P}{C_P{}^2} \cdot AC_i\omega_{3dB}$$

Figure 5F:
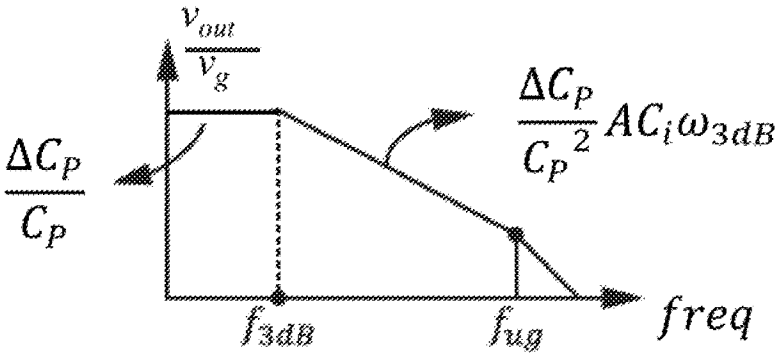
FIG. 5F is a graph of a transfer function, according to an embodiment of the present disclosure.

The resulting transfer function is plotted in FIG. 5F. At low frequencies, $V_{out}/V_g \approx \Delta C_p/C_P$.

For frequencies less than $f_{3\ dB}$, the differential impedance looking into the input terminals may be that of a large capacitor Ci*A (the operational amplifier may cause the relatively small capacitor $C_i$ to look much larger, i.e., to make it look like $C_i$*A). It may be advantageous for this apparent size to be significantly larger than the capacitance of the channel itself, i.e., for the impedance looking into the low-pass current filter to be significantly smaller than the impedance of the channel itself. In this circumstance, the bulk of the current driven by the drive transistor 110 flows into the low-pass current filter. For frequencies between $f_{3\ dB}$ and $f_{ug}$, the differential impedance looking into the input terminals may have the characteristics of a resistor.

Figure 6:
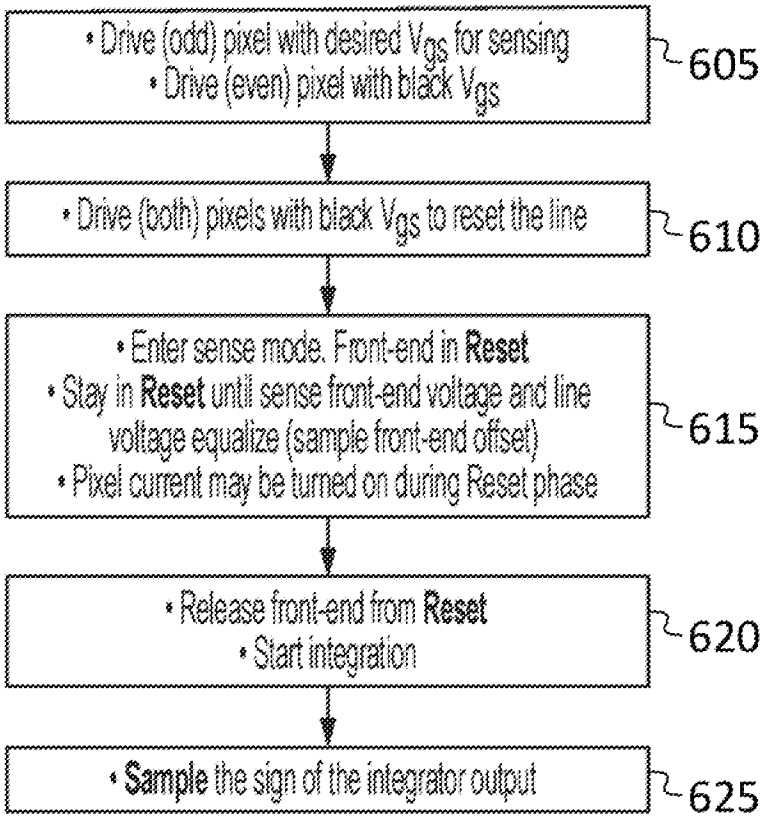
FIG. 6 is a flow chart, according to an embodiment of the present disclosure.

FIG. 6 shows a flow chart of a method for sensing, using the circuits described herein. First, at 605, the odd pixel is driven with the desired $V_{gs}$ for sensing, and the even pixel is driven with the $V_{gs}$ corresponding to black (no emission from the light emitting diode 120). Then, at 610, the upper pass-gate transistor 125 of each pixel is turned off, and both pixels are driven with the $V_{gs}$ corresponding to black, to reset the column conductors 205 (this drive step does not affect the charges on the capacitors of the pixels, because the upper pass-gate transistor 125 of each pixel is turned off). Then, at 615, the circuit enters sense mode. During this step, the front end is in reset, i.e., switches (e.g., transistor switches) connected across the feedback capacitors of the low-pass current filter 405 and the integrator 410 are closed (e.g., the transistors are turned on) so that these capacitors become, and remain, discharged during the reset. The circuit may stay in reset mode until the sense front-end voltage and the voltage on the column conductors 205 equalize; the effect of this state may be to sample the front end offset. The pixel current may be turned on or off (i.e., the control signal EMIT_ENB may be either high or low) during the reset phase. Then, at 620, the front end is released from reset (e.g., the transistors connected across the feedback capacitors are turned off), and integration (of the sensed current) begins. Finally, at 625, the output of the integrator 410 is sampled.

Figure 7:
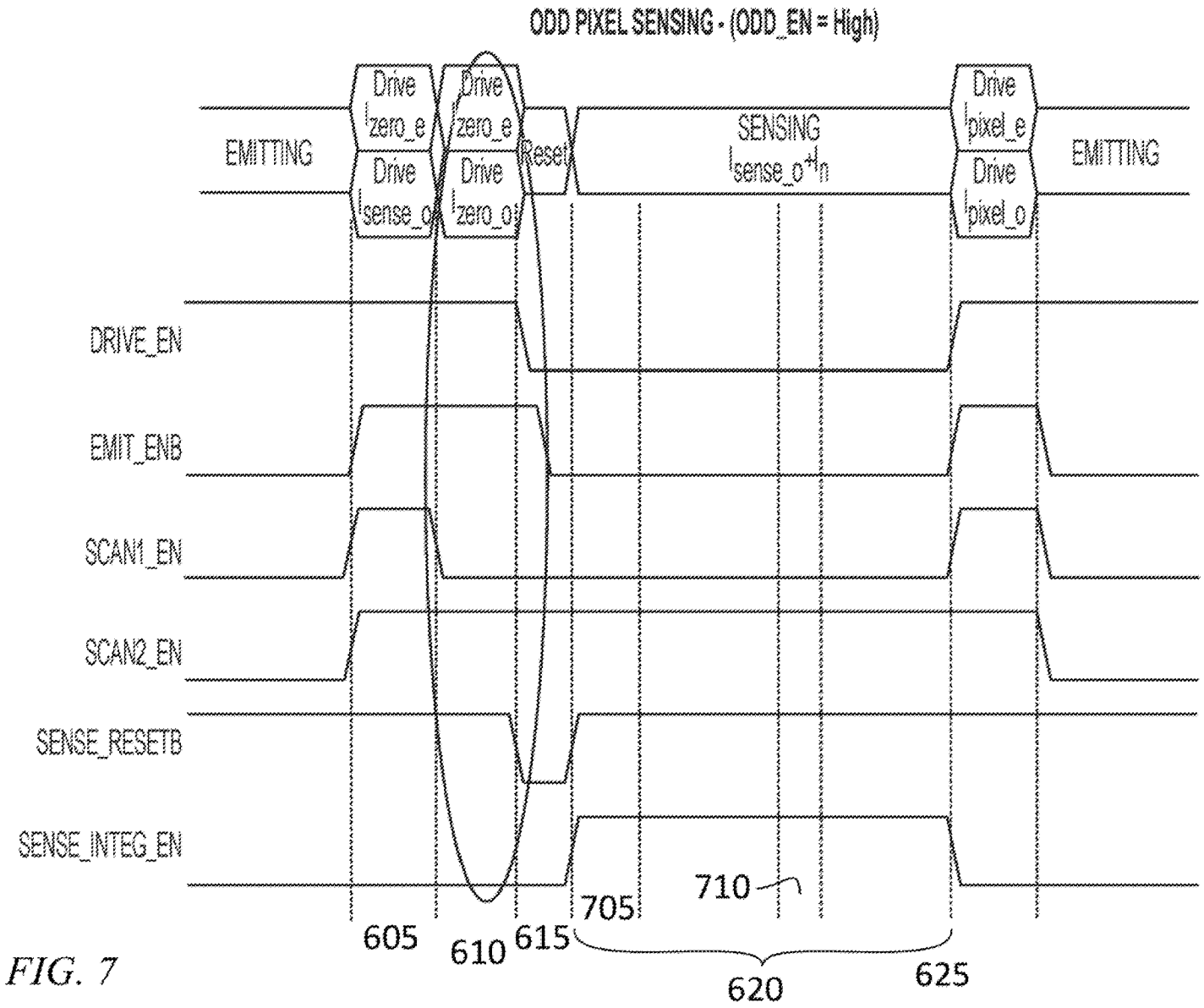
FIG. 7 is a timing diagram, according to an embodiment of the present disclosure.

FIG. 7 is a timing diagram showing control signals for cycling through the states illustrated in FIG. 6. The reference symbols of FIG. 6 are repeated to show the correspondence between the steps of FIG. 6 and time intervals in FIG. 7. Further features, not shown in FIG. 7, may be present in some embodiments. For example, a wait state 705 (in which the low-pass current filter 405 is released from reset and allowed to settle, while the integrator 410 remains in reset mode) may precede the integrating state 620 (which may begin correspondingly later). As another example, in some embodiments, the integrating state is divided into two portions, in one of which the currents from both the even and odd pixels are turned off (by turning off the lower pass-gate transistors 130, using the SCAN2_EN control signal), and in the other of which the even and odd pixels are turned on (by turning on the lower pass-gate transistors 130, using the SCAN2_EN control signal). During the transition between the two portions, the polarity of the connection between the low-pass current filter 405 and the integrator 410 may be reversed, so that the output of the integrator, at the end of the second portion, may be the difference between the current when the pixels are on and the current when the pixels are off (the latter of which may include contributions (e.g., leakage currents from other pixels to the extend their effect is not identical in the even and odd pixels) that are not of interest). As such, operating in this mode may reduce errors due to such currents that are not the current to be sensed (the current driven by the drive transistor 110 of the odd pixel). A hold state 710, during which the low-pass current filter 405 is disconnected from the integrator 410 may also be present, to reduce errors that otherwise may be introduced as a result of imperfect timing when the pixel current and reference current are turned on. The SENSE_RESETB and SENSE_INTEG_EN signals may be used to control the reset states of the low-pass filter and integrator respectively. The SENSE_INTEG_EN signal may remain low until the end of the wait state 705 if a wait state is used.

As used herein, an "input" of a circuit includes one or more conductors and may include further inputs. For example, a differential input may include a first conductor identified as a noninverting input and a second conductor identified as an inverting input. Similarly, an "output" of a circuit, as used herein, includes one or more conductors and may include further outputs. For example, a differential output may include a first conductor identified as a noninverting output and a second conductor identified as an inverting output. As used herein, when a first component is described as being "selectively connected" to a second component, the first component is connected to the second component by a switch (e.g., a transistor switch), so that, depending on the state of the switch, the first component may be connected to the second component or disconnected from the second component.

Although the present disclosure provides examples of a fully differential circuit in applications in which it is used for sensing a pixel circuit, the present disclosure is not limited to such applications, and systems and methods disclosed herein may be employed in other applications, such as, for example, biomedical applications.

In some embodiments, the control of various control signals and of circuits like the digital to analog converter may be performed by a processing circuit. The term "processing circuit" is used herein to mean any combination of hardware, firmware, and software, employed to process data or digital signals. Processing circuit hardware may include, for example, application specific integrated circuits (ASICs), general purpose or special purpose central processing units (CPUs), digital signal processors (DSPs), graphics processing units (GPUs), and programmable logic devices such as field programmable gate arrays (FPGAs). In a processing circuit, as used herein, each function is performed either by hardware configured, i.e., hard-wired, to perform that function, or by more general purpose hardware, such as a CPU, configured to execute instructions stored in a non-transitory storage medium. A processing circuit may be fabricated on a single printed circuit board (PCB) or distributed over several interconnected PCBs. A processing circuit may contain other processing circuits; for example a processing circuit may include two processing circuits, an FPGA and a CPU, interconnected on a PCB.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art. As used herein, the term "major portion", when applied to a plurality of items, means at least half of the items.

As used herein, the singular forms "a" and "an" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present disclosure". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

Any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein.

Although exemplary embodiments of a system and method for sensing drive current in a pixel have been specifically described and illustrated herein, many modifications and variations will be apparent to those skilled in the art. Accordingly, it is to be understood that a system and method for sensing drive current in a pixel constructed according to principles of this disclosure may be embodied other than as specifically described herein. The invention is also defined in the following claims, and equivalents thereof.

What is claimed is:

1. A system, comprising:

a first pixel;

a second pixel;

a differential sensing circuit;

a reference current source; and a control circuit, the differential sensing circuit having a first input, a second input, and an output, the first input being connected to a node at which a reference current generated by the reference current source is subtracted from a first pixel current, the first pixel current including a current generated by the first pixel;

the second input being configured to receive a second pixel current, the second pixel current including a current generated by the second pixel;

the output being configured to produce an output signal based on a difference between a current received at the first input and a current received at the second input;

the control circuit being configured to:

cause the first pixel to be turned on;

cause the second pixel to be turned off; and cause the reference current source to generate the reference current, wherein the differential sensing circuit comprises a low-pass current filter, and a common-mode feedback circuit connected between an output and an input of the low-pass current filter.

2. The system of claim 1, wherein:

the system comprises a display panel comprising the first pixel and the second pixel, the first pixel is in a first column of the display panel, the second pixel is in a second column of the display panel, and the first pixel and the second pixel are adjacent, and in a same row of the display panel.

3. The system of claim 2, wherein:

the first pixel current further includes leakage currents from a plurality of pixels in the first column, other than the first pixel, and the second pixel current includes leakage currents from a plurality of pixels in the second column, other than the second pixel.

4. The system of claim 1, wherein the low-pass current filter comprises a fully differential amplifier.

5. The system of claim 4, wherein the common-mode feedback circuit comprises a common-mode feedback amplifier with a bandwidth of at least 1 MHz.

6. The system of claim 2, wherein the differential sensing circuit further comprises an integrator, connected to the output of the low-pass current filter.

7. The system of claim 6, further comprising a drive circuit, wherein a first conductor of the display panel is connected to the first pixel, the first conductor being configured:

in a first state of the system, to carry the first pixel current, and in a second state of the system, to carry a current from the drive circuit to the first pixel.

8. The system of claim 7, wherein the control circuit is configured, in the second state:

to cause the low-pass current filter to operate in a reset state, and to cause the drive circuit to drive the first conductor to a reference voltage.

9. The system of claim 1, wherein the input of the low-pass current filter is a common-mode input, and the common-mode feedback circuit is configured to average voltages at the output of the low-pass current filter, and provide the average to the common-mode input of the low-pass current filter.

10. A method for sensing a current in a display, the display comprising:

a first pixel;

a second pixel;

a differential sensing circuit; and a reference current source;

the differential sensing circuit having a first input, a second input, and an output, the method comprising:

feeding to the first input a difference between a first pixel current and a reference current generated by the reference current source, the first pixel current including a current generated by the first pixel;

feeding to the second input a second pixel current, the second pixel current including a current generated by the second pixel;

producing at the output an output signal based on a difference between the current received at the first input and the current received at the second input;

turning the first pixel on;

turning the second pixel off; and generating the reference current, wherein the differential sensing circuit comprises a low-pass current filter, and a common-mode feedback circuit connected between an output and an input of the low-pass current filter.

11. The method of claim 10, wherein:

the display comprises a display panel comprising the first pixel and the second pixel, the first pixel is in a first column of the display panel, the second pixel is in a second column of the display panel, and the first pixel and the second pixel are adjacent, and in a same row of the display panel.

12. The method of claim 11, wherein:

the first pixel current further includes leakage currents from a plurality of pixels in the first column, other than the first pixel, and the second pixel current includes leakage currents from a plurality of pixels in the second column, other than the second pixel.

13. The method of claim 10, wherein the low-pass current filter comprises a fully differential amplifier.

14. The method of claim 10, wherein the common-mode feedback circuit comprises a common-mode feedback amplifier with a bandwidth of at least 1 MHz.

15. The method of claim 11, wherein the differential sensing circuit further comprises an integrator, connected to the output of the low-pass current filter.

16. The method of claim 15, wherein the display further comprises a drive circuit, wherein a first conductor of the display panel is connected to the first pixel, the first conductor being configured:

in a first state of the display, to carry the first pixel current, and in a second state of the display, to carry a current from the drive circuit to the first pixel.

17. The method of claim 16, further comprising, in the second state:

operating the low-pass current filter in a reset state, and driving, by the drive circuit, the first conductor to a reference voltage.

18. The method of claim 10, wherein the input of the low-pass current filter is a common-mode input, and the method further comprises:

averaging voltages at the output of the low-pass current filter; and providing the average to the common-mode input of the low-pass current filter.

19. A system, comprising:

a first pixel;

a second pixel;

a differential sensing circuit;

a reference current source; and means for controlling, the differential sensing circuit having a first input, a second input, and an output, the first input being connected to a node at which a reference current generated by the reference current source is subtracted from a first pixel current, the first pixel current including a current generated by the first pixel;

the second input being configured to receive a second pixel current, the second pixel current including a current generated by the second pixel;

the output being configured to produce an output signal based on a difference between a current received at the first input and a current received at the second input;

the means for controlling being configured to:

cause the first pixel to be turned on;

cause the second pixel to be turned off; and cause the reference current source to generate the reference current, wherein the differential sensing circuit comprises a low-pass current filter, and a common-mode feedback circuit connected between an output and an input of the low-pass current filter.

20. The system of claim 19, wherein:

the system comprises a display panel comprising the first pixel and the second pixel, the first pixel is in a first column of the display panel, the second pixel is in a second column of the display panel, the first pixel and the second pixel are adjacent, and in a same row of the display panel.

* * * * *